US006206202B1

(12) United States Patent
Galk et al.

(10) Patent No.: US 6,206,202 B1
(45) Date of Patent: Mar. 27, 2001

(54) CYCLONE SEPARATOR

(75) Inventors: Joachim Galk, Lohmar; Peter Hoffmann, Gladbach; Wolfgang Peukert, Rösrath, all of (DE)

(73) Assignee: Hosokawa Mikropul Gesellschaft fur Mahl-und Staubtechnik mbH, Cologne (DE)

( * ) Notice: Subject to any disclaimer, the term of this patent is extended or adjusted under 35 U.S.C. 154(b) by 0 days.

(21) Appl. No.: 09/142,291

(22) PCT Filed: Mar. 2, 1997

(86) PCT No.: PCT/EP97/01035

§ 371 Date: Dec. 21, 1998

§ 102(e) Date: Dec. 21, 1998

(87) PCT Pub. No.: WO97/32673

PCT Pub. Date: Sep. 12, 1997

(30) Foreign Application Priority Data

Mar. 4, 1996 (DE) ..... 196 08 142

(51) Int. Cl.[7] ..... B04C 5/00

(52) U.S. Cl. ..... 209/715; 209/138; 209/145; 209/133; 209/140

(58) Field of Search ..... 209/138, 140, 209/143, 145, 146, 152, 154, 715, 716, 717, 718, 719; 210/512.1; 55/474

(56) References Cited

U.S. PATENT DOCUMENTS 3,904,515 * 9/1975 MacKenzie et al. ..... 209/3
5,188,237 2/1993 Schwamborn ..... 209/23
5,201,422 * 4/1993 Ihara et al. ..... 209/144

FOREIGN PATENT DOCUMENTS 1292479 8/1958 (DE) .
91 01 419 U1 2/1991 (DE) .
4116683 A1 5/1991 (DE) .
468426 A2 7/1991 (EP) .
7111 394 2/1953 (GB) .

* cited by examiner

*Primary Examiner*—Donald P. Walsh
*Assistant Examiner*—Mark Beauchaine
(74) *Attorney, Agent, or Firm*—Fay, Sharpe, Fagan, Minnich & McKee, LLP

(57) ABSTRACT

A cyclone separator (1) has an elongated vertical housing (2), whose upper section (3) is equipped with a carrier gas/product inlet (4), a separating wheel (6), and a carrier gas/fine product discharge (7). A lower section (9) of the housing defines an oversized product discharge (11). The housing (2) has a central axially extending built-in unit (12), which separates the cyclone carrier gas/particle flow stream, downwardly in a peripheral region, and upwardly in a central region. A lower built-in unit section (14) is joined to a cylindrical middle built-in unit section (15). An entry area of the middle section (15) is equipped with a constrictor (19) which with the built-in body forms a Venturi. Finally, a secondary air supply (24) enters into a lower inlet opening (9) of the lower built-in unit section (14) facing the constrictor (19). An injector effect is achieved which increases the suction, resulting in further improvement of the separating and sorting properties.

18 Claims, 1 Drawing Sheet

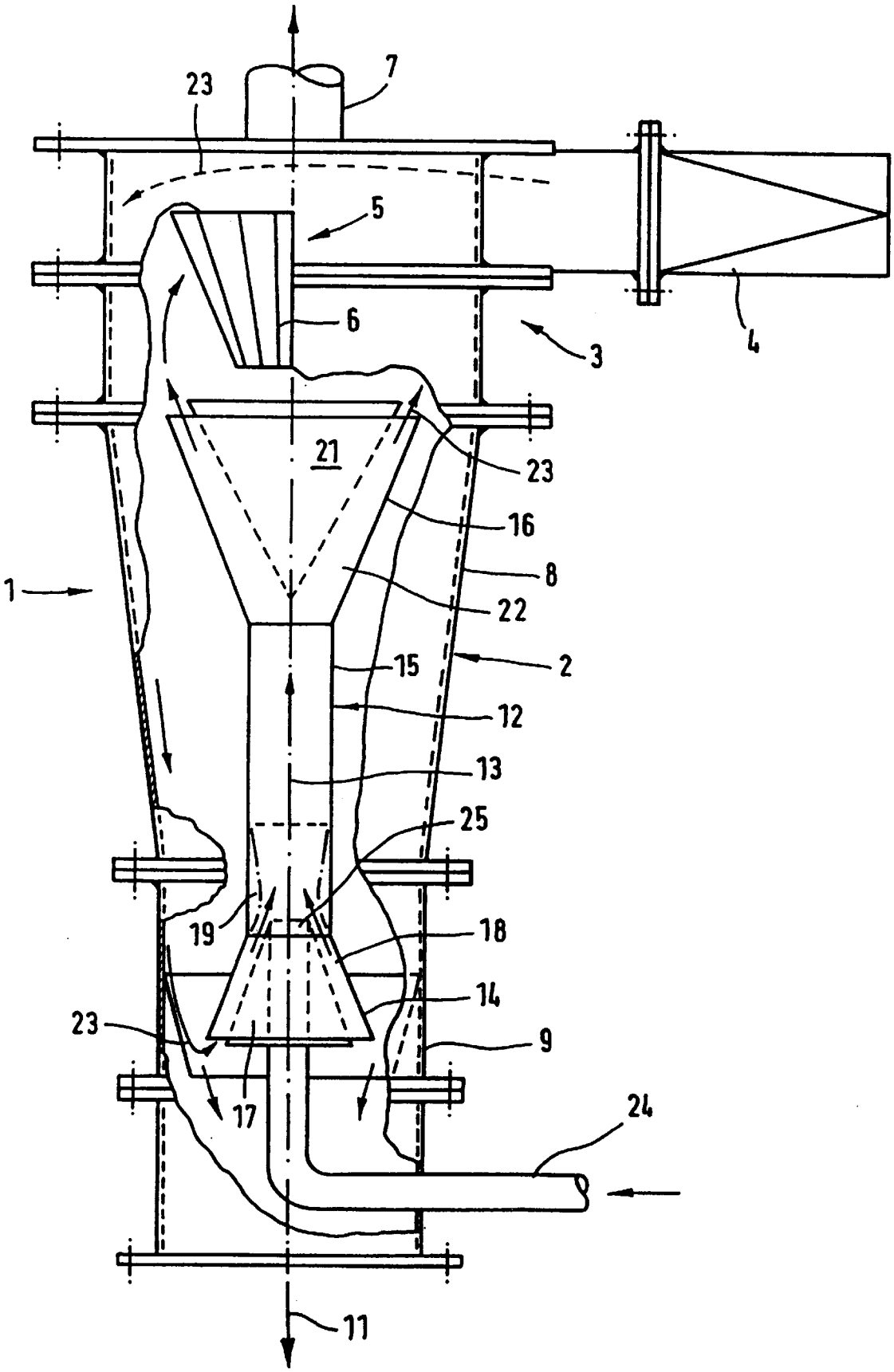
7
23
5
6
3
4
21
23
16
8
1
22
15
2
12
13
25
19
18
14
23
9
17
24
11

CYCLONE SEPARATOR

BACKGROUND OF THE INVENTION

The present invention relates to particle separated separators. It finds particular application in conjunction with cyclone separators, more particularly cyclone separators with an elongated and essentially vertical housing. The upper section is equipped with a carrier gas/product inlet, with a separator, a separating wheel and a discharge for a carrier gas and fine material. In whose lower section, an oversize material discharge is located.

Increasingly higher demands are imposed with respect to granulometric distribution during production, treatment and/or processing of powders, for example in the field of manufacturing coating powders. The goal is to obtain a narrow grain-size distribution curve, i.e., sharp upper grain or particle size limits as well as efficient product sifting. Attainment of these goals becomes more difficult as the grain-size distribution specifications become more restricted.

Cyclone separators of the initially mentioned type (see DE-U-91 01 419) are employed for the separation of powders into a coarse portion and a fine portion, i.e., for influencing the granulometric distribution of powders. With this arrangement, the properties of both a cyclone separator and a sifter are utilized.

SUMMARY OF THE INVENTION

This invention is based on the objective of improving the sorting of a cyclone sifter of the above type.

In one aspect of the present invention, the cyclone separator has a housing with a central, essentially axially extending unit. It separates the cyclone-typical carrier gas/particle streams in a downward direction in the peripheral region and in an upward direction in the central region. This achieves a regulated flow direction. Sifting is significantly improved in the region where the peripheral downward flow turns into the upward directed central flow (direction of deflection). Moreover, a defined solid particle distribution results in the grading zone.

In a second aspect of the present invention, secondary air is admitted so that the inlet in a lower conical section becomes an injector.

An advantage of the present invention is that it achieves improved sorting of particulate material.

Still further advantages of the present invention will become apparent to those of ordinary skill in the art upon reading and understanding the following detailed description of the preferred embodiments.

BRIEF DESCRIPTION OF THE FIGURE

The invention may take form in various components and arrangements of components, and in various steps and arrangements of steps. The drawing is only for purposes of illustrating a preferred embodiment and is not to be construed as limiting the invention.

The FIGURE illustrates a cyclone separator in accordance with the present invention, shown in part elevation and in part sectional view.

DETAILED DESCRIPTION OF THE PREFERRED EMBODIMENTS

With reference to the FIGURE, the represented cyclone separator 1 has a housing 2, which comprises an upper section 3, which is equipped with a carrier gas/product inlet 4, a separator 5 (only a separator wheel 6 of a dynamic separator is visible) and a carrier gas/fine product discharge 7. The upper section 3 is connected above a housing section 8, which has a tapered cone shape. The housing section 8 converges into a cylindrical section 9, whose lower end forms an oversized product discharge 11 (only depicted by an arrow).

Within the housing 2, a built-in unit 12 is located. It is radially symmetric and extends concentrically vis-a-vis a longitudinal axis 13. Its lower end is located in a section in which the peripheral downward gas/particle flow passes over into a central, upward flow. An upper end of the built-in unit 12 lies immediately below the separator wheel 6.

In the illustrated preferred embodiment, the built-in unit 12 comprises three sections. Its lower section 14 is shaped as an inward tapered cone in the direction of the flow. Its middle section 15 has a cylindrical shape. Its upper section 16 flares outward conically in the direction of the flow.

Within the lower conical section 14, a concentrically arranged, conically shaped, built-in body 17, extends into the cylindrical middle section 15. This produces a conical, in horizontal cross-section annular, inlet channel 18. In the area adjacent the upper end of the built-in body 17, the interior wall of the middle section 15 is fitted with a constrictor 19, which is shaped in such a manner that it forms a Venturi with the built-in body lower section 14. The upper section 16 of the built-in unit 12 which is conically flared in the direction of flow also has a concentric, conical built-in body 21. This defines a conical, in cross-section annular, discharge channel 22, whose orifice is located below the openings in the separator wheel 6.

The streams of carrier gas/particles which form during the operation of the cyclone separator 1 are indicated by arrows 23. From the inlet 4 which is disposed at approximately the same height as the separator wheel 6 and at least partially above the separator wheel 6, the carrier gas/product mixtures flows tangentially into the upper section 3 of the housing 2. From there it flows, outside of the built-in unit 12, spirally in a downward direction. A deflection takes place near a lower edge of the lower section 14 which causes an effective reverse separation. Momentum carries the oversized product into the oversized product discharge 11. Then, the still entrained smaller particles enter the annular channel 18.

The entrance of the conical lower section 14 into the cylindrical middle section 15 forms a Venturi which produces a suction effect during operation, improving the reverse separation and provides an intensive dispersal in the cylindrical section 15. The orifice of the annular discharge channel 22 in the upper section 16 of the built-in unit 12 forms an annular nozzle, which distributes the mixture selectively in an entrance section of the separator wheel 6. Particles passing through the separator wheel merge with the carrier gas into the fine product discharge 7. Particles flung to the outside by the separator wheel 6 merge into the peripheral downward stream and are again separated and sorted.

The suction effect in the entry area of the cylindrical middle section 15 of the built-in unit 12 can be significantly increased by the admission of secondary air. The secondary air is admitted in such a manner that the inlet to the conical lower section 14 forms an injector. In the preferred embodiment, a secondary air line 24 enters the housing 2 through the lower housing section 9, traverses the lower built-in body 17, and terminates in an orifice 25 disposed at the front side of the built-in body 17, facing the constrictor 19. By admitting of secondary air at this location, an injector effect is achieved which increases the suction effect, resulting in further improvement of the separating and sorting properties.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A cyclone separator comprising:

an elongated and essentially vertical housing which includes an upper section and a lower housing section;

a carrier gas/product inlet defined in the upper housing section for receiving a carrier gas/mixed size particle flow;

a separator disposed in the upper housing section;

a carrier gas/fine product discharge defined in the upper section for discharging a carrier gas/fine particle flow;

an oversized product discharge defined in the lower housing section for discharging coarse particles;

a central and essentially axially extending built-in unit disposed in the housing to separate the carrier gas/mixed size particle flow stream, into a downward flow in a peripheral region, and an upward flow in a central region.

2. The cyclone separator according to claim 1, wherein the built-in unit is radially symmetric and extends concentrically vis-a-vis a longitudinal axis of the vertical housing.

3. The cyclone separator according to claim 1, wherein a lower end of the built-in unit is located in an area in which the peripheral downward flow passes over the central upward flow and its upper end lies directly below said separator.

4. The cyclone separator according to claim 1, wherein the built-in unit includes:

a lower built-in unit section which tapers conically in the upward flow direction.

5. The cyclone separator according to claim 4, further including:

a conically tapering body extending into the lower built-in unit section and defines therewith a flow channel having an annular horizontal cross-section.

6. The cyclone separator according to claim 4, wherein the built-in unit further includes:

an essentially cylindrical middle section connected with the lower built-in unit section.

7. The cyclone separator according to claim 6, wherein the middle built-in unit section defines an entry area and further including:

a constrictor in the middle section entry area which, with the built-in body, defines a Venturi.

8. The cyclone separator according to claim 7, wherein said middle section entry area defines an injector.

9. The cyclone separator according to claim 1, wherein the built-in unit includes:

an upper built-in unit section which flares conically outward in a direction of the upward flow.

10. The cyclone separator according to claim 9, wherein the separator includes a separator wheel with peripheral openings and further including:

a conical body extending into the upper built-in unit section, the conical body and the upper built-in unit section defining a flow channel with an annular cross-section and having an orifice which lies below the openings of said separating wheel.

11. The cyclone separator according to claim 1, further including a secondary air supply entering into a lower inlet opening of the lower built-in unit section.

12. The cyclone separator according to claim 8 further including:

an air supply tube with an orifice disposed adjacent a front surface of a conically tapered body in the lower built-in unit section facing the constrictor.

13. The cyclone separator according to claim 1, wherein the separator includes a separating wheel and the carrier gas/product inlet is located at least partially above said separating wheel.

14. The cyclone separator according to claim 11, wherein the secondary air supply includes a tube which traverses a body disposed in the lower built-in unit section and which has an orifice adjacent an upper end of the lower built-in unit section facing upward.

15. A cyclone separator comprising:

a cylindrical housing;

a separating wheel disposed in an upper portion of the housing;

a carrier gas/product inlet connected with an upper portion of the housing such that a carrier gas/mixed size particle flow spirals peripherally and downward through the housing;

a tubular built-in unit mounted along a central axis of the housing, the built-in unit having a flared lower section configured to draw the carrier gas/mixed size particle flow upward through the built-in unit, the built-in unit having a flared upper end disposed below the separating wheel such that carrier gas and fine particles pass through the separating wheel and are discharged through a fine product discharge outlet defined at an upper end of the housing and larger particles are drawn into the peripheral and downward carrier gas/mixed size particle flow;

an oversized product discharge opening defined at a bottom end of the housing such that coarse particles in the carrier gas/mixed size particle flow are propelled through the oversized product discharge opening as less coarse and fine particles and carrier gas are drawn into the lower end of the built-in unit.

16. The cyclone separator according to claim 15 further including:

a Venturi defined adjacent the lower end of the built-in unit to draw the carrier gas and the fine and less coarse particles into the lower end of the built-in unit.

17. The cyclone separator according to claim 15 further including:

a secondary air injector for injecting a flow of secondary air upward adjacent the lower end of the built-in unit to draw the carrier gas and the fine and larger particles into the built-in unit lower end.

18. A method of mechanically separating particles of a selected size from a particle mixture including a range of particle sizes from fine through coarse, the method comprising:

causing a downward, spiralling flow of the particle mixture in a carrier gas;

drawing the carrier gas and fine through less coarse particles upward through a center of the downward spiraling flow such that coarse particles continue downward and fine through less coarse size particles are drawn upward;

adjacent a top of the cyclone flow, mechanically separating particles of a selected size range from the particle mixture and discharging the selected size range particles and returning the other particles to the downward spiraling flow.

* * * * *